United States Patent [19]

Karol

[11] 4,365,858

[45] Dec. 28, 1982

[54] MOLDED PROTECTION CAP

[75] Inventor: James J. Karol, Unadilla, N.Y.

[73] Assignee: The Bendix Corporation, Southfield, Mich.

[21] Appl. No.: 239,956

[22] Filed: Mar. 3, 1981

[51] Int. Cl.[3] ..... H01R 13/44

[52] U.S. Cl. ..... 339/36

[58] Field of Search ..... 339/36, 38, 48, 88 R, 339/88 C, 90 R, 90 C

[56] References Cited

U.S. PATENT DOCUMENTS

| | | | |
|---|---|---|---|
| 2,690,542 | 9/1954 | Pearce et al. | 339/48 |
| 3,129,993 | 4/1964 | Ross | 339/36 X |
| 3,252,124 | 5/1966 | Hansen | 339/90 R X |
| 3,351,886 | 11/1967 | Zimmerman, Jr. | 339/90 R |
| 4,258,970 | 3/1981 | Bourdon et al. | 339/38 |

*Primary Examiner*—Howard N. Goldberg

*Attorney, Agent, or Firm*—Charles D. Lacina; Raymond J. Eifler

[57] ABSTRACT

A one-piece molded protection cap 200 having a bayonet-type coupling arrangement and a resilient member 260 for fitting about a pair of contacts terminated to a cable 50 in a connector 100 of the type including a pair of locking lugs 150. The coupling arrangement includes a pair of separated annular walls 220 with a rigid latch 280 between each with each latch having a V-shaped ridge 250 having a peak 257 for bearing against a lip 154 extending from the lug of the connector, a keyway 254 initially allowing axial approach and retreat of the locking lugs while preventing rotation, the V-shaped ridge then allowing rotation while preventing substantial axial retreat or approach, the resilient member (260) biasing the cap from the connector and locking the lug in a locking recess 258 in the final rotated position.

7 Claims, 11 Drawing Figures

FIG.5
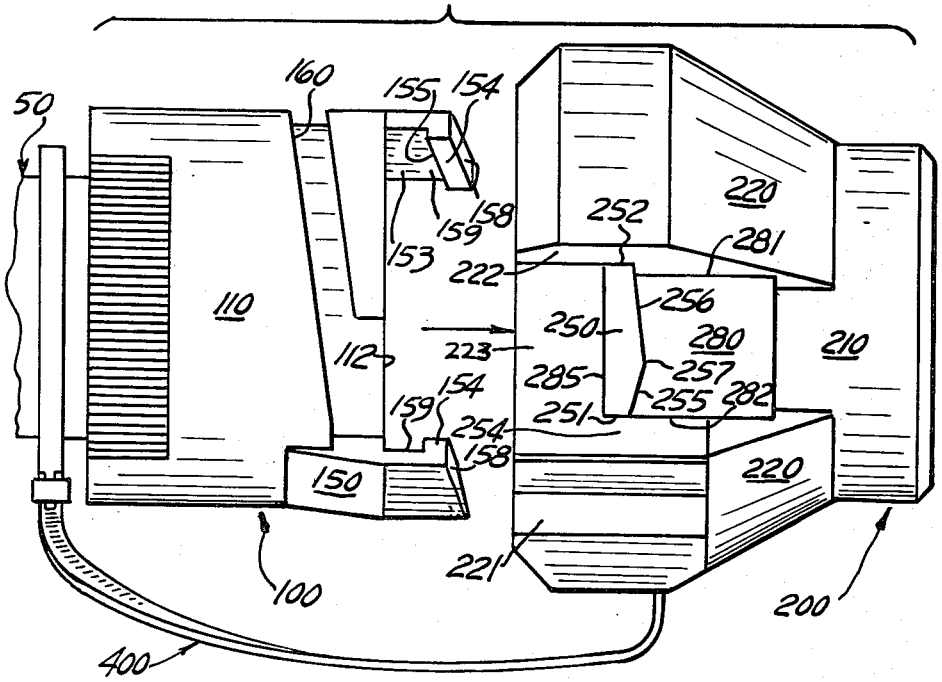
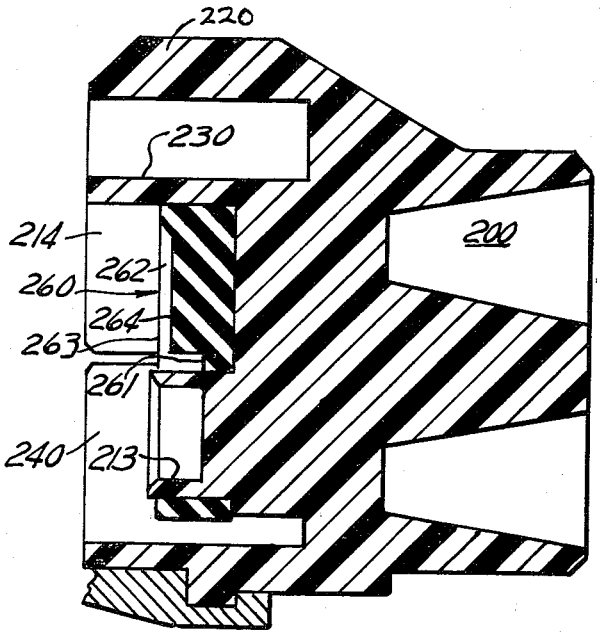
FIG.4

FIG. 6
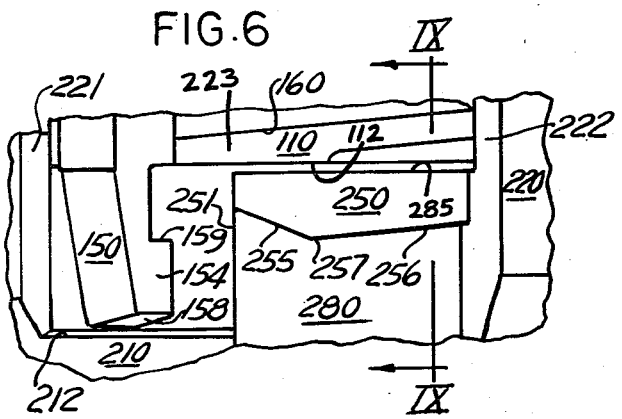
FIG. 9
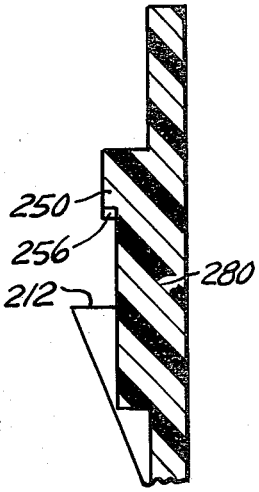
FIG. 7
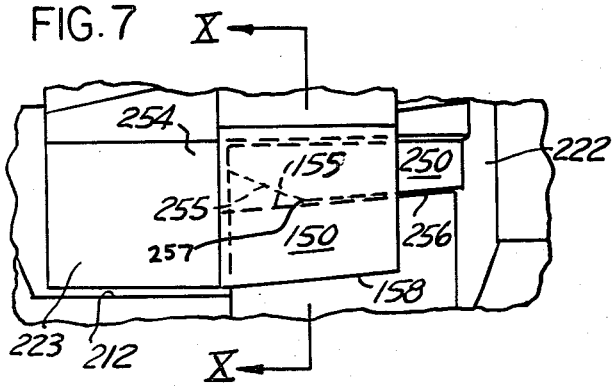
FIG. 10
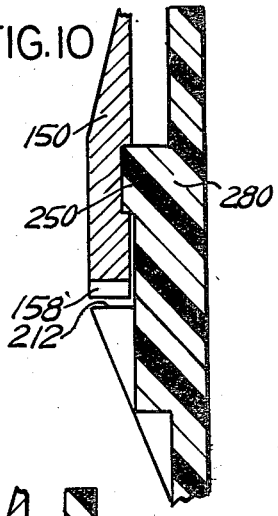
FIG. 8
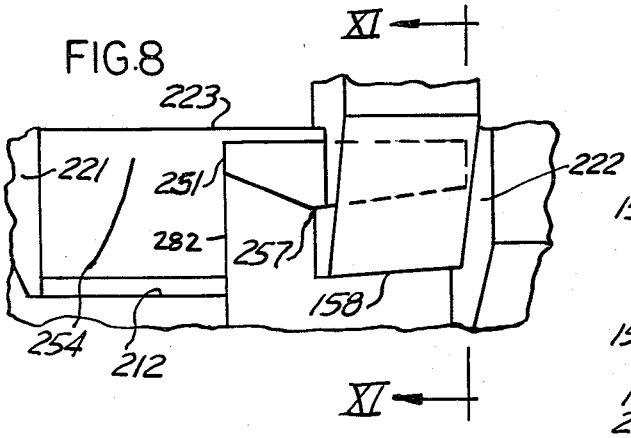
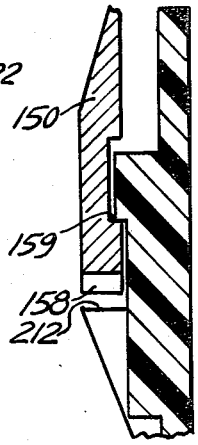
FIG. 11

MOLDED PROTECTION CAP

This invention relates to a molded protection cap for an electrical connector assembled to a cable and of the type providing a bayonet coupling.

Electrical cable assemblies are often times used in field applications. Prior to an electrical interconnection with another connector, contact terminals of a cable assembly connector can be exposed to dirt and/or moisture. The cable assembly may be subjected to other severe environments, such as to substantial impact loads if the assembly were to be dropped, such impact load presenting risk of connector damage.

Protection caps to protect terminations of the contact to the cable are known and typically have been made of metal, a material having relatively high costs of manufacture, high material cost and weight disadvantages. If a connector assembly were protected by a cap made from metal and the assembly were to be dropped, due to increased weight of metal, shock forces in excess of those experienced by the connector alone can jar terminated contacts of the connector assembly, possibly resulting in their disengagement with the cable.

In the past, some electrical connectors have included interlocking devices molded from plastic material and which included resilient members that deflected radially inwardly/outwardly either to engage and/or to disengage. U.S. Pat. No. 4,146,288 to Ramsay et al, issuing Mar. 27, 1979 showed an interlocking member having a pair of lugs, each lug having a chamfered end portion which permitted the connection to "slide" from engagement as a result of cable certain tension. An interlocking device shown by U.S. Pat. No. 4,154,496 to Gallagher, issuing May 15, 1979 and a protection cap shown in U.S. Pat. No. 4,258,970, issuing Mar. 31, 1981 to Bourdon et al, provided a plurality of radially deflectable fingers. Shock or vibration forces can adversely effect such a coupling in the sense of permitting the connection to be released.

U.S. Pat. No. 3,129,993 to Ross issuing Apr. 21, 1964 shows two sets of engageable lugs having complementary sloped surfaces which, as a result of rotational motion of the connector bodies, causes one set of lugs to be cammed against the other set of lugs for final fitment. Such an interference fitment would not be desirable in all applications and would be prone to disconnecting upon a sharp blow.

In the field and due to grit which may attack an exposed connector shell, fine threads would be undesirable because they could foul up the engagement and require many rotations to complete a final fitment. A more desirable fitment would be one that is fast and provide a positive "snap" feel upon mating.

Also in most electrical connection applications, moisture proofing of contacts must be maintained.

Accordingly, it would be desirable to provide an interlocking protection cap which is lightweight, easy and inexpensive to manufacture, which provides a positive lock against unwanted decoupling and which provides moisture from reaching an interconnection between cable and connector.

DISCLOSURE OF THE INVENTION

The invention is a protection cap of plastic or other suitable light weight dielectric material having suitable recesses to orient and/or locate the cap relative to the structure of an existing cable and connector assembly, the assembly of the type including an electrical cable joined in electrical circuit relationship to a contact terminal mounted in an electrical connector such that a forward end of the terminal is exposed for mating and faces forwardly, the connector including a pair of locking lugs with each lug having a forward end portion provided with a radially inwardly directed lip.

The protection cap is characterized by an integrally molded body including a pair of semi-circular walls and a pair of rigid latch members extending axially forward therefrom to define a cavity and a resilient member disposed in the cavity and configured for biasing against the forward end of the connector and for protecting the exposed mating end of the contact terminal. Each semi-circular wall has first and second longitudinal wall ends with the first wall ends being angularly spaced from the second wall ends to define an angular separation therebetween, each separation being sized to dispose one latch member therein. Each latch member has first and second longitudinal latch edges with the first latch edges being adjacent to the second wall ends and the second latch edges being angularly separated from the first wall ends, the first wall ends and second latch edges defining therebetween an axial cut-out for allowing axial approach and retreat of the locking lug. Each latch member further includes a radially outwardly directed ridge. The ridge having a lateral sidewall cooperating with the first wall ends to define a keyway therebetween for preventing rotation of the lug and the connector relative to the cap and a V-shaped portion for engaging the lip and for allowing relative rotation between the cap and the connector while substantially preventing relative axial retreat of the connector from the cap. The V-shaped portion forms a pair of ramps which meet at a peak medial of the latch and which slope axially forwardly from the peak to the first and second latch edges respectively. The resilient member is dish-shaped and includes a base and a conical wall radiating outwardly from the base to a circular forward face, the base including a central portion for covering the terminal and the forward face being configured to bear against the connector to resist axial forward motion thereof. For assembly, each lug is received in the cutout, guided forwardly of the sidewall in the keyway and rotated from the keyway to cause each lip to bear against the first of the ramps and the connector and cap to advance axially towards one another, further rotation advancing the lip beyond the peak, whereupon the resilient member biases each of the lugs into a locked relation in recesses formed between the medial peak and the second ends of the walls.

One advantage of the present cap is ease of interlocking assembly with a connector to be mated.

Another advantage is a rigid bayonet-type lock that is achieved.

Yet another advantage of the present invention is that the cap moisture-proofs an exposed end of the cable-to-connector assembly when secured thereto.

The foregoing and other advantages and features of the present invention will become apparent to one skilled in the art from the following detailed description taken in conjunction with the accompanying drawings and claims which form a part of this specification. Further, the use of numerals is for the purpose of clarification only and not intended to limit the specific structure illustrated.

BRIEF DESCRIPTION OF THE DRAWINGS

FIG. 4 is an elevation view of the protection cap partially in section taken along lines IV—IV of FIG. 3.

FIG. 5 is an elevation view of the protection cap of FIG. 2 about to be coupled with the connector of FIG. 1.

FIGS. 6, 7 and 8 illustrate the coupling sequence between the connector and the protection cap.

FIGS. 9, 10 and 11 show the coupling sequence partially in section taken along lines IX—IX, X—X and XI—XI respectively of FIGS. 6, 7 and 8.

DETAILED DESCRIPTION OF THE INVENTION

Figure 1:
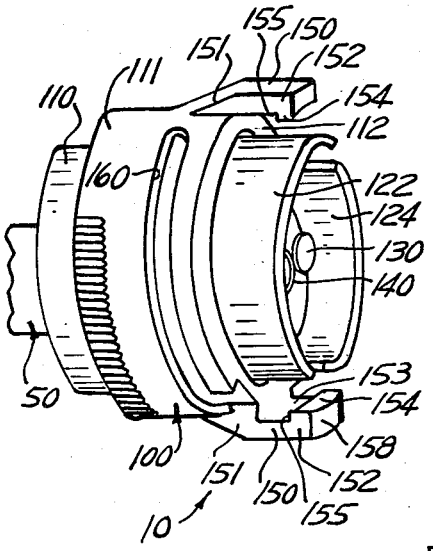
FIG. 1 is a perspective view of a cable assembled to a prior art connector.

FIG. 1 is a perspective view of a connector 100 assembled with a cable 50 to form a cable assembly 10 contemplated for use by the present invention. Cable 50 preferably includes two coaxial conductors, each conductor being terminated by a contact of the connector.

The connector 100 is hermaphroditic in that it will mate with an identical second connector (not shown) and includes a body 110, an outer shell 111 having an annular rim 112, a pair of angularly separated semicircular locating rings or annular wall portions 122, 124 that extend axially forward of the rim, a pair of connecting lugs 150 and a pair of contacts 130, 140. The semi-circular locating rings 122, 124 extend forwardly of contacts 130, 140 to protect the contacts and serve to orient the connector during mating either with the second connector or with a protection cap of the present invention.

The first semi-circular locating ring (wall portion) 122 has a larger diameter than the second locating ring (wall portion) 124. In a mating between the first connector and the second connector the smaller locating ring of the second connector (e.g., corresponding to wall portion 124) fits within the separation formed between the ends of larger semicircular locating ring 122 of the illustrated connector 100. The larger locating ring of the second connector (e.g., corresponding to wall portion 122) fits within the separation formed between the ends of, around and outside of the smaller locating ring 124 of the illustrated connector 100.

Each of the contacts 130, 140 include a pair of terminals (not shown) as a termination of one coaxial conductor. Each contact is thus a termination of a single coaxial line and the present arrangement of two coaxial lines in a single cable and termination has been commonly referred to in the trade as a twin-axial cable. Each contact terminal is mounted in the connector such that a forward end of the terminal is exposed for mating and faces forwardly.

The shell 111 is provided with the locking lugs 150, each lug having one end portion 151 secured to the exterior of the shell and the other end portion 152 extending axially forward from the rim 112, each lug being disposed radially outside of the semi-circular locating rings 122, 124. The lugs 150 are diametrically disposed about the circumference of the shell. Each lug includes an inner wall 153 having a lip 154 extending radially inwardly therefrom towards the locating rings to define an undercut 159. Each lip 154 includes a forward axial face 158 and an axial helically inclined surface 155 which faces the rim 112. The shell includes on the outer surface thereof a lug recess 160 adjacent to each lug which spirals as a helix axially rearwardly from the rim 112. Lugs associated with the second connector are configured to engage the lug recesses 160 of the connector 100 (illustrated) and the lugs 150 of connector 100 being adapted to engage corresponding lug recesses of the second connector, co-rotation of each connector connecting the two connectors together. Only one of the two recesses 160 is shown in this view.

Figure 2:
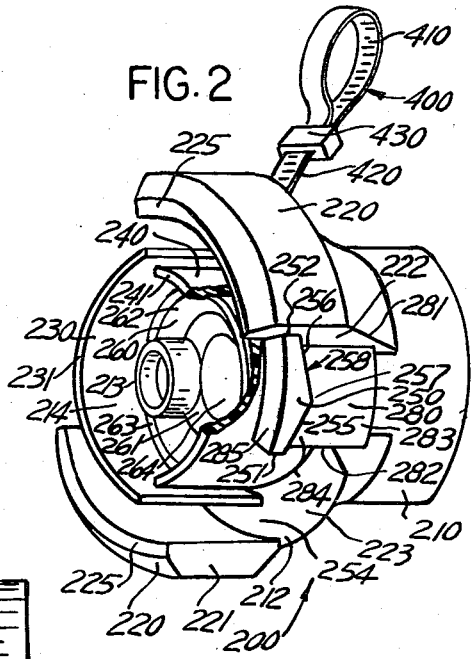
FIG. 2 is a perspective view of a protection cap for use with the connector of FIG. 1.

FIG. 2 shows a protection cap 200 as contemplated by the present invention. The protection cap 200 is preferably a molded one-piece body made from a polymeric material such as a glass-filled type nylon or other suitable plastics which are well known in the art. The cap 200 includes a generally cylindrical shell or body 210 having an annular shoulder 212, a pair of annular outer walls 220 having a forward axial face 225, a pair of semi-circular inner walls 230, 240 having forward annular faces 231, 241, a pair of latch members 280 (only one visible in this view) and a resilient member 260 disposed centrally of the semi-circular inner walls, each of the pairs of walls being generally coaxial one with the other and each extending axially forward from the annular shoulder 212 to define a cavity 214 for the resilient member.

The annular outer walls 220 each include first and second longitudinal wall ends 221, 222 with the first wall ends 221 being angularly spaced around the shoulder 212 from the second wall ends 222 to define an angular separation therebetween, each separation being sized to dispose one latch member 280 and to receive one of the lugs 150 of the connector 100 when the connector 100 is mated with the protection cap.

Each latch 280 has a radial width defined between first and second longitudinal latch edges 281, 282, the first latch edges 281 being adjacent to the second wall ends 222 and the second latch edges 282 being angularly separated from the wall ends 221, the first wall ends 221 and the second latch edges 282 defining an axial cut-out 223 for allowing axial approach and retreat of the locking lug 150. As shown, the second wall end 222 is secured to the first latch edge 281. The latch 280 has one axial end portion 283 rigidly secured to the body and the other end portion 284 extending outwardly from the shoulder, the latch being sufficiently rigid to resist radial flexure of the forward end portion 284 relative to the body 210. A forward axial face 285 of the latch 280 is spaced intermediately of the forward face 225 of the outer annular walls 220 and the annular shoulder 212.

The latch 280 includes a radially outwardly extending raised portion defining a ridge 250, the ridge 250 having a pair of lateral sidewalls 251, 252 and a V-shaped portion for engaging the lip 150. The first lateral sidewalls 251 cooperate with the first wall ends 221 to define keyways 254 therebetween for preventing relative rotation between the lug and connector and the cap. The V-shaped portion is a contiguous extension of the sidewalls and allows relative rotation between the cap and the connector lugs while substantially preventing relative axial retreat of the connector from the cap, the V-shaped portion being formed by a pair of abutment ramps 255, 256 which slope rearwardly from lateral sidewalls 251, 252 respectively towards the shoulder 212 to meet at a peak 257, the slope of the second ramp 256 being substantially the same spiral angle as the spiraling portion on the lug inner surface 155. The angular-distance between the medial peak 257 and the second wall end 222 is somewhat greater than the angular width of the locking lug 150 and forms a locking recess 258 therefor.

The resilient member 260 is a dish-shaped gasket and includes a circular base 261, a conical wall 262 radially expanding outwardly from the base to a circular forward axial face 263 and a contact fitment portion 264 (a contact receiving cavity) axially rising from on the base. A second contact fitment portion 213 extends upwardly from the body 210 and through an aperture formed in the gasket base. Silicone rubber, such as AMS-3222, which will not take a permanent set and will stay resilient after a period of load is one suitable material.

Additionally, protection cap 200 is molded with an integral lanyard 400 for connecting the cap 200 to the cable 50 of the connector assembly 10. The lanyard 400 includes a flexible strap 410 which has one end 420 attached to the body 210, a loop portion being formed by the other end 430 of the lanyard. As shown, the lanyard 400 could consist of a cable bundling tie of the type having an apertured locking head and a toothed strap having an end thereof extending from the head for insertion into the head aperture. A hole would be provided in the strap end 420 to assist the strap in being integrally molded to the cap.

Figure 3:
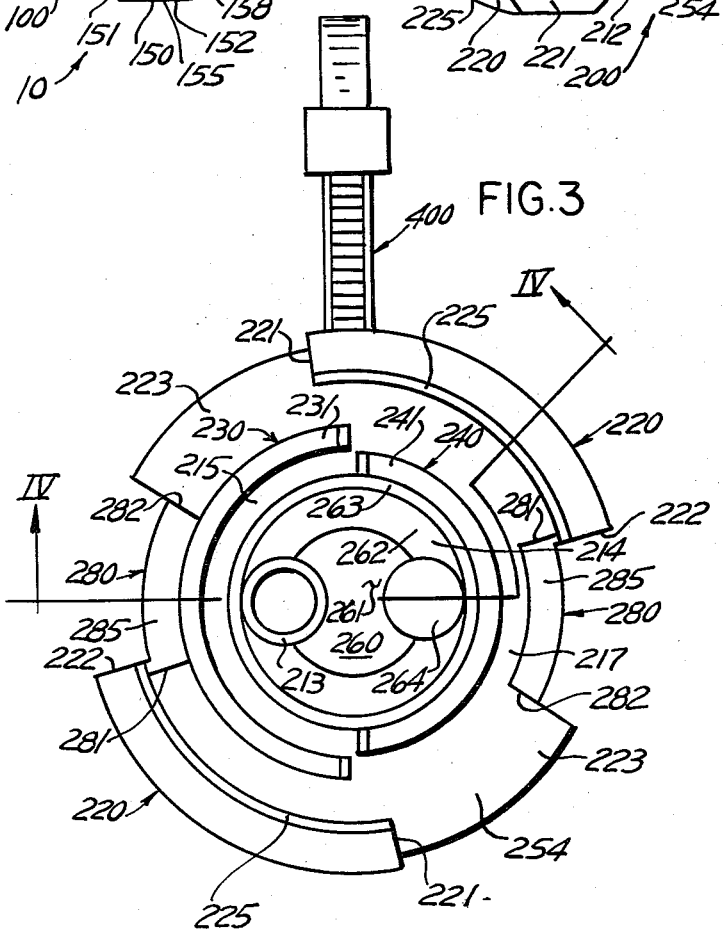
FIG. 3 is a plan view of the protection cap of FIG. 2.

FIG. 3 is a front view of the cap 200 showing the pairs of coaxial walls and particularly showing the relationship between the outer walls 220 and the two semicircular inner walls 230, 240, the cavity 214 for the resilient member 260 and the two contact fitments 264, 213. Also shown are the two latches 280 with each having one latch edge 281 thereof secured to one wall end 222 and the other latch edge 282 free and angularly spaced from the other wall end 222.

FIG. 4 is a cross sectional view of the cap 200 taken along the line IV—IV in FIG. 3. The cap 200 includes the outer walls 220, the inner walls 230, 240 and the cavity 214. The annular dish-shaped bias member 260 is mounted within the cavity 214 with the wall 262 thereof extending completely around the cavity and about the contact receiving cavities 264, 213 to form a closure cup for the connector contacts.

FIG. 5 shows the lanyard 400 securing the protection cap to the cable 50 and positioning the connector 100 for receiving the cap. The semi-circular walls 220, 230 have been omitted for better showing the lugs 150. The lugs 150 are axially aligned with the keyway 254.

IN OPERATION

Turning now to FIGS. 6, 7 and 8, and their associated section views 9, 10 and 11, the protection cap 200 is axially aligned with and fitted about the connector 100 such that each lug 150 is in the axial cut-out 223 formed between the wall ends 221, 222 of the outer walls 220 of the cap. Only one lug 150 and one cut-out 223 is shown for illustration. In FIG. 6, the two bodies 110, 210 are axially thrust together whereby the top forward face 158 of the lug 150 is disposed axially adjacent to but not contacting the annular shoulder 212 of the protection cap. The annular rim 112 of the connector is axially adjacent to the forward face 285 of the latch 280. FIGS. 7 and 10 show the two bodies being co-rotated relative to one another, the shell 111 being rotated relative to the cap 200, causing the lug 150 to fit about the lip 154 and the lug surface 155 to bear against the first ramp 255 resulting in the lug 150 being cammed axially forward by a small amount toward the annular shoulder 212 of the body. As the lug is rotated, the lip 154 rides over the medial peak 257 and substantially contacts the second ramp 256 of the latch member. In FIGS. 7 and 10, the medial peak 257 of latch 280 is shown bearing down on the lip 150, thereby forcing the connector slightly toward the cap in an axial direction. In FIGS. 8 and 11, the lug 150 has been rotated to its final position in the locking recess 258 formed between the peak 257 and the wall end 222 of the cap. Here, due to the resilient member 260, the conical wall 262 bears against and exerts an upward force against the connector, biasing the connection radially apart. This force, in combination with the cooperation between the helical surfaces of the lip and ramp 255, tends to lock the lug 150 in the recess 285. This force is sufficient to prevent unwanted decoupling therebetween. Decoupling of the lugs 150 would require the connectors to overcome forces presented by the sloped portion and the peak.

Mating of the connector 100 and the cap 200 is accomplished by aligning the lug 150 with an axial cut-out adjacent the latch 280 and aligning the locating rings and walls of the cap and the connector 100. As the protection cap 200 is inserted over the connector 100, the larger semicircular locating ring 122 of the connector fits around the smaller semicircular inner wall 240 of the plastic cap and within a first cap recess and the smaller locating ring 124 fits inside of the larger inner wall 230 of the plastic cap in a second cap recess between the inner wall 230 and an internal body portion of the plastic cap.

While a preferred embodiment of this invention has been disclosed, it will be apparent to those skilled in the art, that changes may be made to the invention as set forth in the appended claims, and in some instances, certain features of the invention may be used to advantage without corresponding use of other features. Accordingly, it is intended that the illustrative and descriptive materials herein will be used to illustrate the principles of the invention and not to limit the scope thereof.

I claim:

1. A molded protection cap (200) for an assembly of the type including an electrical cable (50) joined in electrical circuit relationship to a contact terminal (130) mounted in an electrical connector (100) such that a forward end of the terminal is exposed for mating and faces forwardly, said connector including a pair of locking lugs (150) being provided with a radially inwardly directed lip (154), said protection cap (200) characterized by:

an integrally molded body (210) including a pair of walls (220) and a pair of rigid latch (280) members extending axially forward therefrom to define a cavity (214); and a resilient member (260) disposed in the cavity and configured for biasing against the forward end of the connector and providing a cover for protecting the exposed mating end of the contact terminal;

each wall (220) having first and second longitudinal wall ends (221, 222) with the first wall ends (221) being spaced from the second wall ends (222) to define a separation therebetween sized to dispose one latch member therein;

each said latch member (280) having first and second longitudinal latch edges (281, 282) with the first of said latch edges (281) being adjacent to the second of said wall ends (222) and the second of said latch edges (282) being spaced from the first of said wall ends (221);

each said latch member further including a radially outwardly directed ridge (250) having a lateral sidewall (251) cooperating with the first of said wall ends (221) to define a keyway (254) for allowing axial approach and retreat of the locking lug and for preventing rotation of the lug and the connector relative to the cap and a V-shaped portion for engaging the lip, the V-shaped portion including a pair of ramps (255, 256) which slope from the first and second latch edges respectively to meet at a peak (257) medial of the latch and which allow relative rotation between the cap and the connector while substantially preventing relative axial retreat of the connector from the cap;

a lug locking recess (258) being defined between the peaks (257) and the second ends (222) of the walls, whereby for assembly each lug (150) is guided forwardly in the keyway (254) and rotated from the keyway, thus causing each lip (154) to bear against the first ramp (255) and the connector and cap to advance axially towards one another, further rotation advancing the lip (154) over and beyond the peak (257) whereupon the resilient member (260) biases the lug (150) into a locked relation in the recess (258).

2. A molded protection cap as required in claim 1 wherein the resilient member (260) is dish-shaped and includes a base (261) having a conical wall (262) radiating outwardly therefrom to a circular forward face (263), the base (261) including a central contact receiving cavity (264) for covering the exposed contact terminal, the forward face (263) being configured to bear against the connector to resist axial forward motion thereof.

3. A separable electrical connector assembly (10), characterized by as comprising:

two bodies (110, 210) having forward portions connectible in alignment with forward faces thereof brought into confronting relation when interconnected, the first shell (110) being terminated to a cable (50) of the type having a two-terminal contact portion (130, 140) exposed for mating in the forward portion thereof and the second shell (210) forming a portion of a one-piece protection cap (200) of plastic material for protecting the exposed terminals;

a pair of connecting lugs (150) axially extending from the forward face of the first shell with each of said lugs having a radially inwardly extending lip (154) having an inclined axial surface disposed in facing relationship to the forward face of the first shell;

interfitting keying means (254) on the second shell allowing axial approach and retreat of the connector lugs while preventing relative rotation of the shells;

resilient compressible means (260) disposed within the protection cap for opposing movement of the shells axially inwardly towards one another, said compressible means being adapted to register about the terminals and provide moisture sealing therewith; and interfitting retaining means (255, 256) on the second shell allowing rotational movement of the connector lugs while substantially preventing relative axial movement of the shells to one another, said retaining means including a pair of latch members (280) with each corresponding to one of said lugs and being defined by a rigid wall (284) having a radially outwardly extending lip (250), each of said lips (250) being generally V-shaped to define a pair of axially rearwardly facing ramps (255, 256) and a medial peak (257), whereby as the connecting lugs are rotated, each lug is caused to bear against the first ramp (255), thereby drawing the shells together until the lug is rotated past the medial peak, whereby the compressible means forces the shells axially apart and locks the shells in position with their forward faces confronting each other.

4. In combination, an assembly characterized by:

an electrical connector (100) having at least one electrical terminal (130) mounted in a forward end thereof and including a body portion (110) with an annular rim (112) and at least one locking lug (150) extending axially forward from the annular rim of said connector, said locking lug including a lip (154) directed radially inward;

an electrical cable (50) of the type including at least one inner conductor terminating to the terminal;

a protection cap (200) adapted to be coupled to the forward end of said electrical connector, said cap comprising a body (210), an annular wall (220) extending from the forward end of the cap body to define a cavity (214), a keyway (254) for allowing only axial approach and retreat of the locking lug and at least one substantially rigid latch member (280) for engaging the locking lug when rotated from the keyway; and a resilient member (260) mounted in said cavity and configured for biasing against the forward end of the connector body and for protecting the exposed mating end of the terminal mounted in the connector;

the latch member (280) including a ridge (250) directed radially outward therefrom, the ridge having a V-shaped portion defining first and second ramps (255, 256) which meet at a point (257) medial of the latch;

the assembly being formed by the protection cap being axially inserted into the keyway (254) and then rotated, thereby causing the inwardly directed lip of the lug to engage the first ramp (255) of the latch and the resilient member (260) to cover the exposed terminal, further rotation causing the cap to be advanced axially towards the connector until such point as the locking lug (150) clears the medial point (257) of the ridge (250), whereupon the resilient member (260) axially biases the connector and cap apart to form a locked assembly.

5. An assembly of the type described in claim 4 wherein the protection cap is one-piece and molded from a glass-filled type nylon material.

6. An assembly of the type described in claim 5 wherein the resilient member is of a silicon rubber and includes an annular portion which fits about the exposed end of the terminal and an annular wall.

7. A protection cap (200) for an electrical connector (100) of the type including a shell (110) having an annular front rim (112), a pair of lugs (150) extending from the shell and a contact terminal (130) mounted in the shell with a forward end thereof exposed for mating, each lug (150) having a lip (154) extending radially inwardly therefrom for locking with another, characterized by:

an integrally molded body (210) including a pair of angularly separated walls (220) and a latch member (280) in each separation for engaging one lug, said walls and lugs extending axially forwardly from the body to define a cavity (214) about a front mating face of the body; and a resilient member (260) disposed in the cavity and configured for biasing against the forward end of the connector and protecting the exposed terminal, each latch (280) including a ridge (250) extending radially outwardly therefrom for engaging the lug rotated thereover, the ridge having a pair of lateral sidewalls (251, 252) and a V-shaped portion defined by a pair of ramps (255, 256) meeting at a peak (257) medial to the sidewalls and configured to bear against the lip, the first sidewalls (251) being angularly spaced from a first wall ends 221 to define a keyway (254) therebetween for allowing axial approach and retreat while preventing relative rotation of the lug, the second sidewalls (252) being adjacent to the second wall ends 222 to define a locking recess (258) between the peak (257) and the second wall end (222) for locking the lip when the lug is rotated past the peak;

whereby for assembly, the connecting lug is received in the keyway, advanced past the one sidewall and then rotated against the ridge of latch member, resulting in the lip bearing against the first ramp and then towards and over the peak, whereupon the resilient member biases outwardly against the connector to lock the lug.

* * * * *